US007331122B2

(12) United States Patent
Januszewski et al.

(10) Patent No.: US 7,331,122 B2
(45) Date of Patent: Feb. 19, 2008

(54) CONVERTIBLE SANDAL

(75) Inventors: John J. Januszewski, Blackstone, MA (US); Andre Mossiat, Millis, MA (US); Robert Ruth, Brockton, MA (US); Brian Foresta, Amsterdam, MA (US)

(73) Assignee: Reebok International Ltd., Canton, MA (US)

( * ) Notice: Subject to any disclaimer, the term of this patent is extended or adjusted under 35 U.S.C. 154(b) by 0 days.

(21) Appl. No.: 11/148,447

(22) Filed: Jun. 9, 2005
(Under 37 CFR 1.47)

(65) Prior Publication Data

US 2006/0075656 A1 Apr. 13, 2006

Related U.S. Application Data

(60) Provisional application No. 60/578,321, filed on Jun. 10, 2004.

(51) Int. Cl.
*A43B 3/12* (2006.01)

(52) U.S. Cl. ..... 36/11.5; 36/100; 36/15

(58) Field of Classification Search ..... 36/15, 36/11.5, 100, 101
See application file for complete search history.

(56) References Cited

U.S. PATENT DOCUMENTS

| | | | | |
|---|---|---|---|---|
| 2,112,761 | A * | 3/1938 | Buehner | 36/11.5 |
| 2,153,968 | A * | 4/1939 | Loufbahn | 36/11.5 |
| 2,590,648 | A * | 3/1952 | Pitz | 36/11.5 |
| 3,154,866 | A * | 11/1964 | Laufbahn | 36/101 |
| 4,297,798 | A * | 11/1981 | Colan | 36/101 |
| 4,839,948 | A * | 6/1989 | Boros | 24/662 |
| 4,887,369 | A * | 12/1989 | Bailey et al. | 36/101 |
| 5,992,058 | A * | 11/1999 | Jneid | 36/100 |
| 6,237,249 | B1 * | 5/2001 | Aguerre | 36/11.5 |
| 6,349,486 | B1 * | 2/2002 | Lin | 36/101 |
| 6,543,157 | B2 * | 4/2003 | Pan | 36/11.5 |
| 6,640,464 | B2 * | 11/2003 | Hsin et al. | 36/11.5 |
| 2001/0001350 | A1 * | 5/2001 | Aguerre | 36/31 |
| 2003/0145490 | A1 * | 8/2003 | Tsai | 36/15 |
| 2005/0252036 | A1 * | 11/2005 | Laska | 36/11.5 |
| 2006/0090374 | A1 * | 5/2006 | Hillyer et al. | 36/100 |

* cited by examiner

*Primary Examiner*—Marie Patterson
(74) *Attorney, Agent, or Firm*—Sterne, Kessler, Goldstein & Fox P.L.L.C.

(57) ABSTRACT

An article of footwear to be used as a convertible sandal comprising a sole, a forefoot cover, and heel strap. The forefoot cover is securely attached to the sole and extends over the forefoot portion of the sole. The heel strap is linked to the sole and extends over the heel portion of the sole. Further, the sole includes a sidewall having an interlocking section along the heel portion of the sole. The heel strap is adapted to be set within the interlocking section of the sidewall of the sole to thereby hold the rear heel support to the sidewall of the sole. As such, a user has the option of using the heel strap to secure his heel to the heel portion of the sandal, or alternatively setting the heel strap within the interlocking section of the sidewall and thereafter using the sandal in a "flip-flop" style.

24 Claims, 10 Drawing Sheets

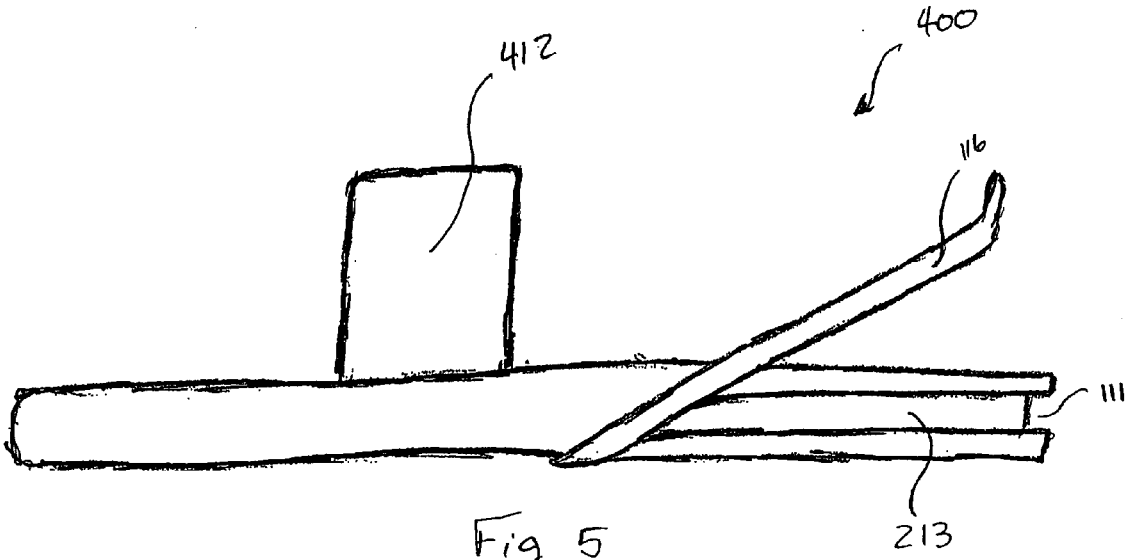
Fig 5
Fig. 6
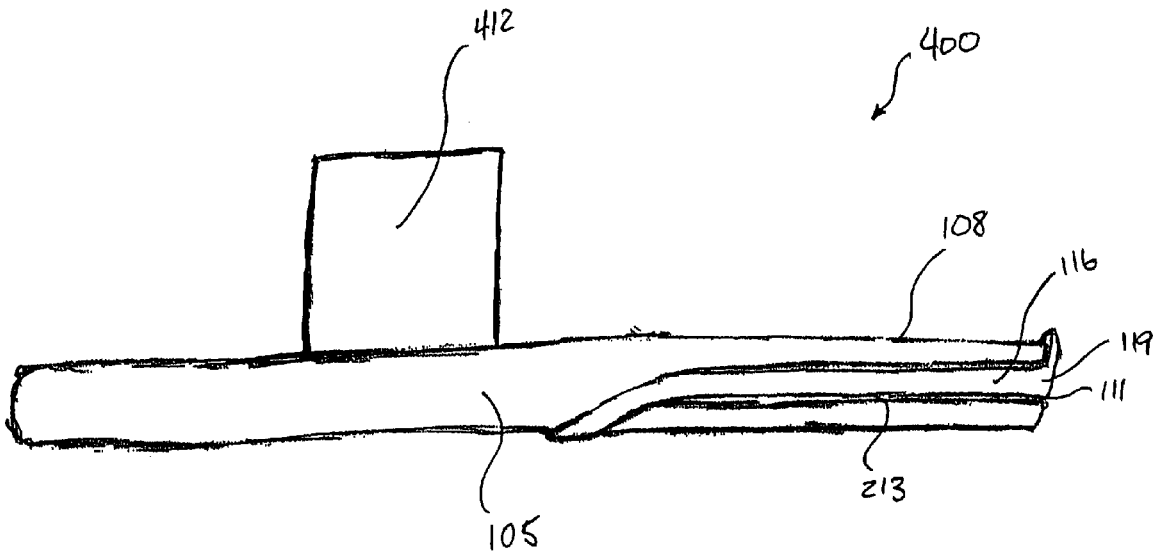

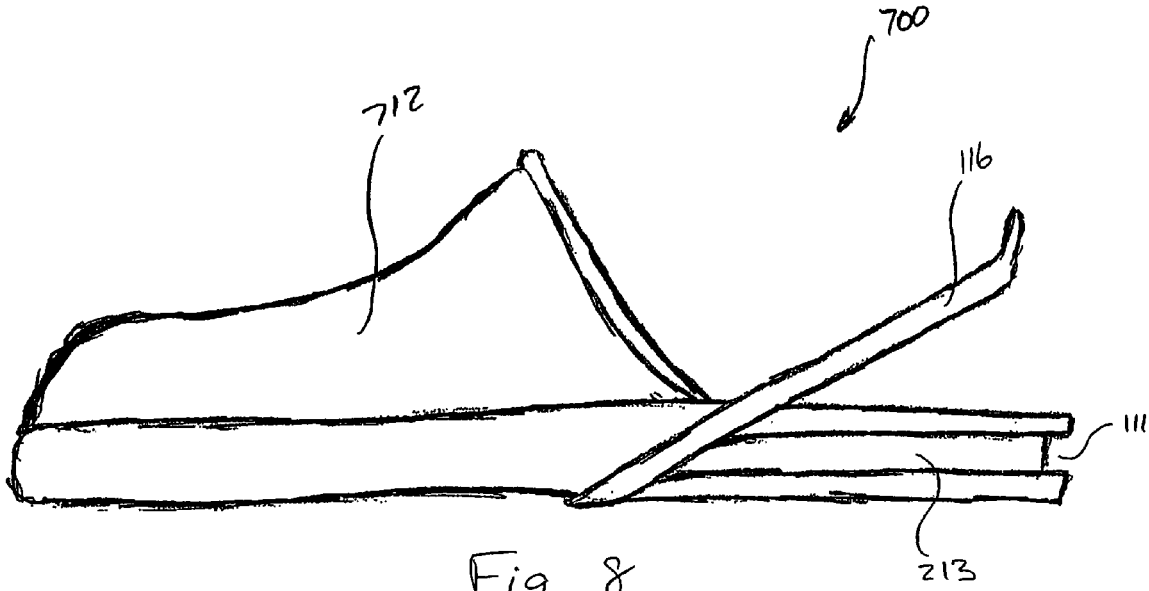
Fig. 8
Fig. 9
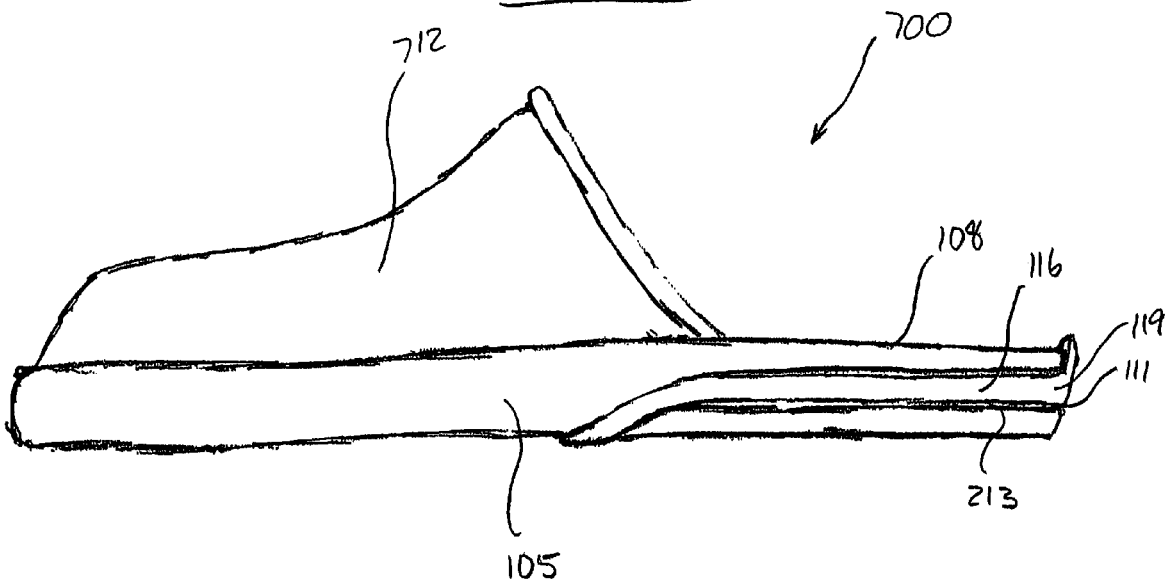

CONVERTIBLE SANDAL

CROSS REFERENCE TO RELATED APPLICATIONS

The present application claims the benefit of the filing date of U.S. Provisional Application No. 60/578,321, filed Jun. 10, 2004, under 35 U.S.C. § 119(e). The disclosures of the above-referenced application is incorporated herein by reference in its entirety.

BACKGROUND OF THE INVENTION

1. Field of the Invention

The present invention relates generally to footwear. More specifically, the present invention relates to a convertible sandal having a heel strap that is capable of being interlocked with the heel portion of the sandal.

2. Related Art

Sandals are a common and widely used type of footwear. Early sandals included a flat component, formed of a suitable material such as leather, that served as a sole. Various methods to secure the sandal to a user's foot are known. For example, a forefoot cover, or vamp, can be used to cover the instep of the user's foot and thereby secure the sandal to the foot. The forefoot cover may only partially cover the top of the foot so that the toes extend outward into the open air. In the alternative, the forefoot cover may cover most of the top of the foot or even enclose the entire forward portion of the foot.

Sandals having only forefoot covers are sometimes referred to as "slide" sandals or "flip-flop" sandals. As such, the sandal is only loosely attached to the foot and is useful for more leisurely types of activities. More active types of activities, requiring quicker movements, could result in the sandal becoming inadvertently disconnected from the foot, which might be undesirable.

An improvement to the "flip-flop" sandal is the addition of a strip of material, referred to as a heel strap, which ties or wraps around the user's heel. The rear heel strap can be connected to the forefoot cover or other structural components of the sandal. The rear heel strap is typically formed of a material such as a synthetic fabric or leather.

Some sandals employ a rear heel strap that can be disconnected from the sandal. To achieve this disconnect feature, the sandal can incorporate buckles, hook and eye fasteners and other types of mechanical fasteners to connect and disconnect at least one end of the rear heel strap to and from the sandal. If both ends of the rear heel strap can be disconnected, the sandal can be used as a "slide" or "flip-flop" styled sandal. Once removed, however, it would be necessary to store or carry the rear heel strap to prevent loss thereof. Since sandals are often used at the beach and at swimming pools, storage of the rear heel strap in order to avoid loss could be inconvenient. Thus, there is a need for a convertible sandal, that includes a forefoot cover and a rear heel strap, and can be utilized with or without the heel strap without disassembling the sandal.

SUMMARY OF THE INVENTION

Presented herein is a convertible sandal having a sole, a forefoot cover, and a heel strap. The forefoot cover is securely attached to the sole and extends over the forefoot portion, or toe portion, of the sole. The forefoot cover is preferably in the form of a thong, but alternatively may be in the form of a slide, a vamp, a foot strap, a sock, or a clog.

The heel strap is linked to the sole and extends over the heel portion of the sole. The sole includes an interlocking section, preferably formed along the side wall of the heel portion of the sole. The heel strap is adapted to be able to set within the interlocking section of the sole, and thereby interlock, or removably secure the heel strap to the heel portion of the sole. As such, a user can wear the sandal with the heel strap around his heel, or alternatively interlock the heel strap with the interlocking section, and thereby wear the sandal in a "slide" or "flip-flop" fashion.

BRIEF DESCRIPTION OF THE FIGURES

The accompanying figures, which are incorporated herein and form part of the specification, illustrate a convertible sandal. Together with the description, the figures further serve to explain the principles of the convertible sandal described herein and thereby enable a person skilled in the pertinent art to make and use the convertible sandal.

FIG. 5 is a side view of the convertible sandal of FIG. 4 having the heel strap in a raised position.

FIG. 6 is a side view of the convertible sandal of FIG. 4 having the heel strap in a lowered position.

FIG. 8 is a side view of the convertible sandal of FIG. 7 having the heel strap in a raised position.

FIG. 9 is a side view of the convertible sandal of FIG. 7 having the heel strap in a lowered position.

DETAILED DESCRIPTION OF THE INVENTION

Preferred embodiments of a convertible sandal are described below with reference to the figures where like reference numbers indicate identical or functionally similar elements. Also in the figures, the left most digit of each reference number corresponds to the figure in which the reference number is first used. While specific configurations and arrangements are discussed, it should be understood that this is done for illustrative purposes only. A person skilled in the relevant art will recognize that other configurations and arrangements can be used without departing from the spirit and scope of the appended claims.

Figure 1:
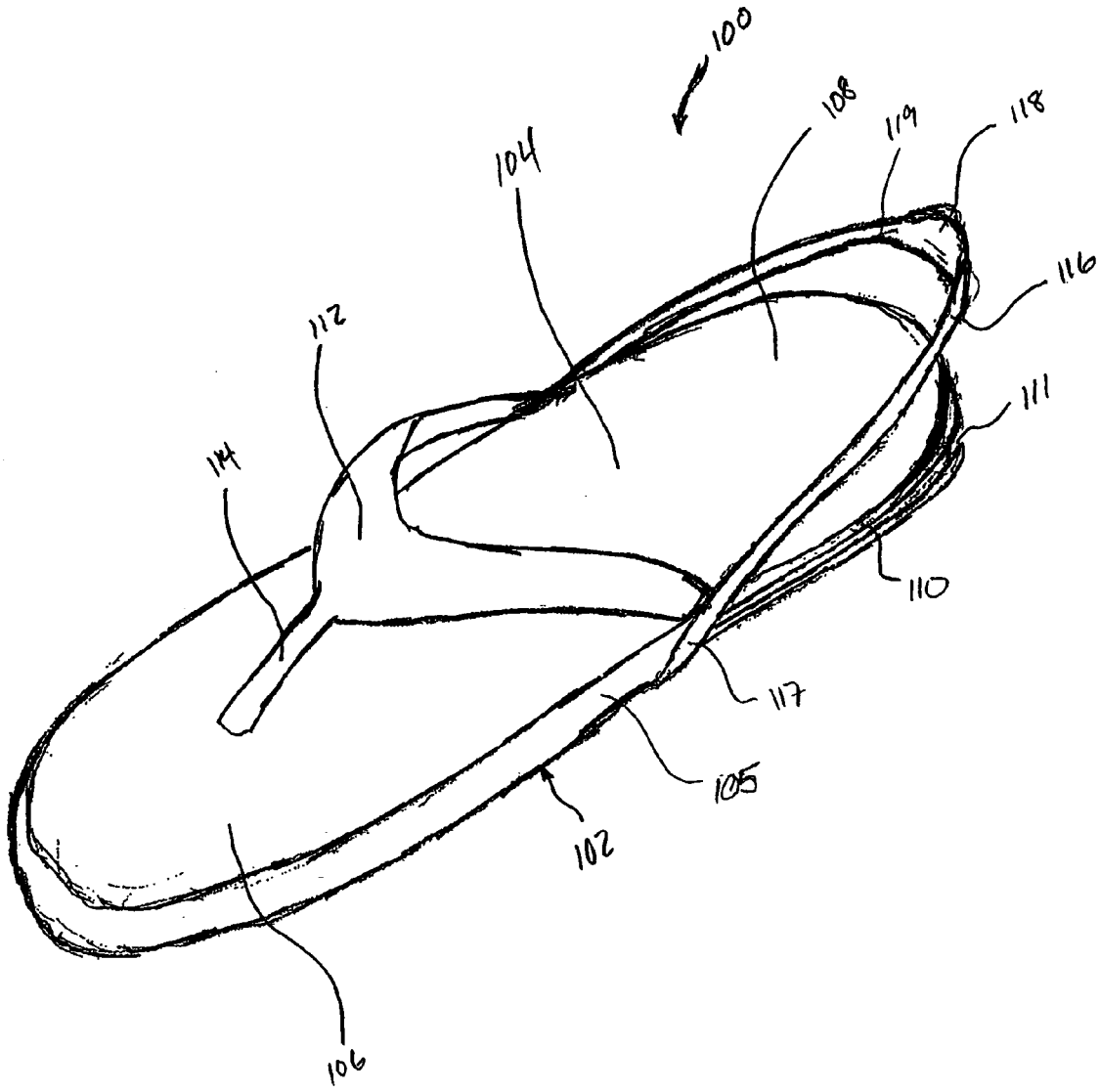
FIG. 1 is an elevated view of a convertible sandal.

FIG. 1 is an elevated view of a convertible sandal 100. Convertible sandal 100 is comprised of a sole 102, or base member, which includes a top surface 104, or foot bed, a midsole 105, and an outsole (not shown). The sole 102 may include a separate insole (not shown) or sock-liner (not shown). The top surface 104 is typically formed of a rubber material; however, the top surface can alternatively be comprised of a synthetic fabric, leather, or any other material known to the art. The top surface 104 may also be contoured to fit the shape of a human foot or modified in any manner to increase the comfort of the user. The top surface 104 is typically adhered to the midsole 105 using conventional methods. The midsole 105 is typically formed of blown ethylene vinyl acetate (EVA). The top surface 104 may alternatively be formed of the same material as the midsole 105. The outsole (not shown) is discussed in conjunction with FIG. 13.

The sole 102 can be divided into a forefoot portion 106, or toe portion, and a heel portion 108. The forefoot portion 106 begins at approximately the middle of the sole and extends forward to the area wherein a user's toes would set. The heel portion 108 begins at approximately the middle of the sole and extends backward to the area wherein the user's heel would set.

Figure 3:
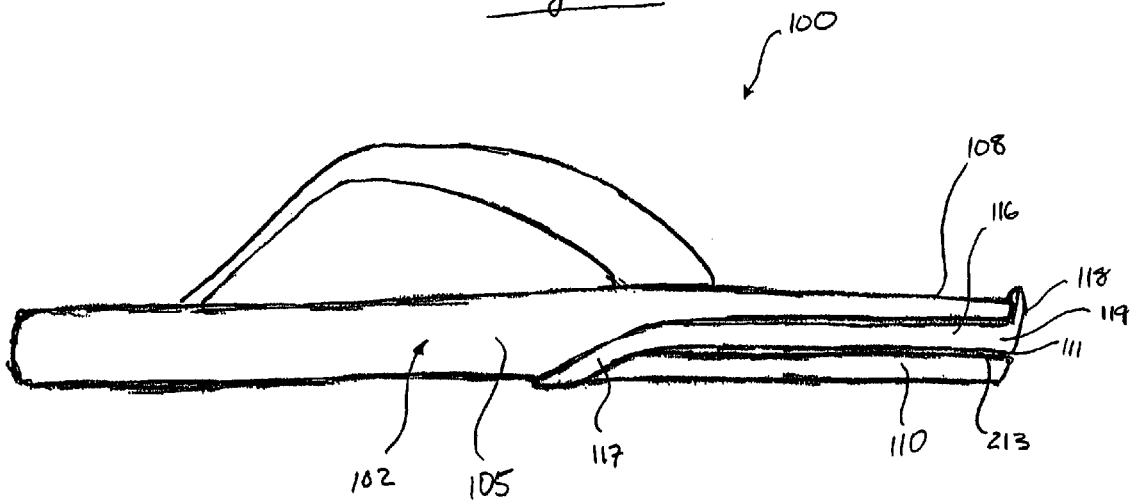
FIG. 3 is a side view of the convertible sandal of FIG. 1 having the heel strap in a lowered position.

Forming a perimeter around the midsole 105 is a sidewall 110. The sidewall 110 is preferably integral with the midsole 105 and is formed of the same material as the midsole. Along the heel portion 108 of the midsole 105, the sidewall 110 includes a groove 111, or indentation. The groove 111, serves as an interlocking section in which a heel strap 116 may be set within (as shown in FIG. 3). The groove 111, preferably has a thickness approximately equal to the thickness of the heel strap 116.

Figure 4:
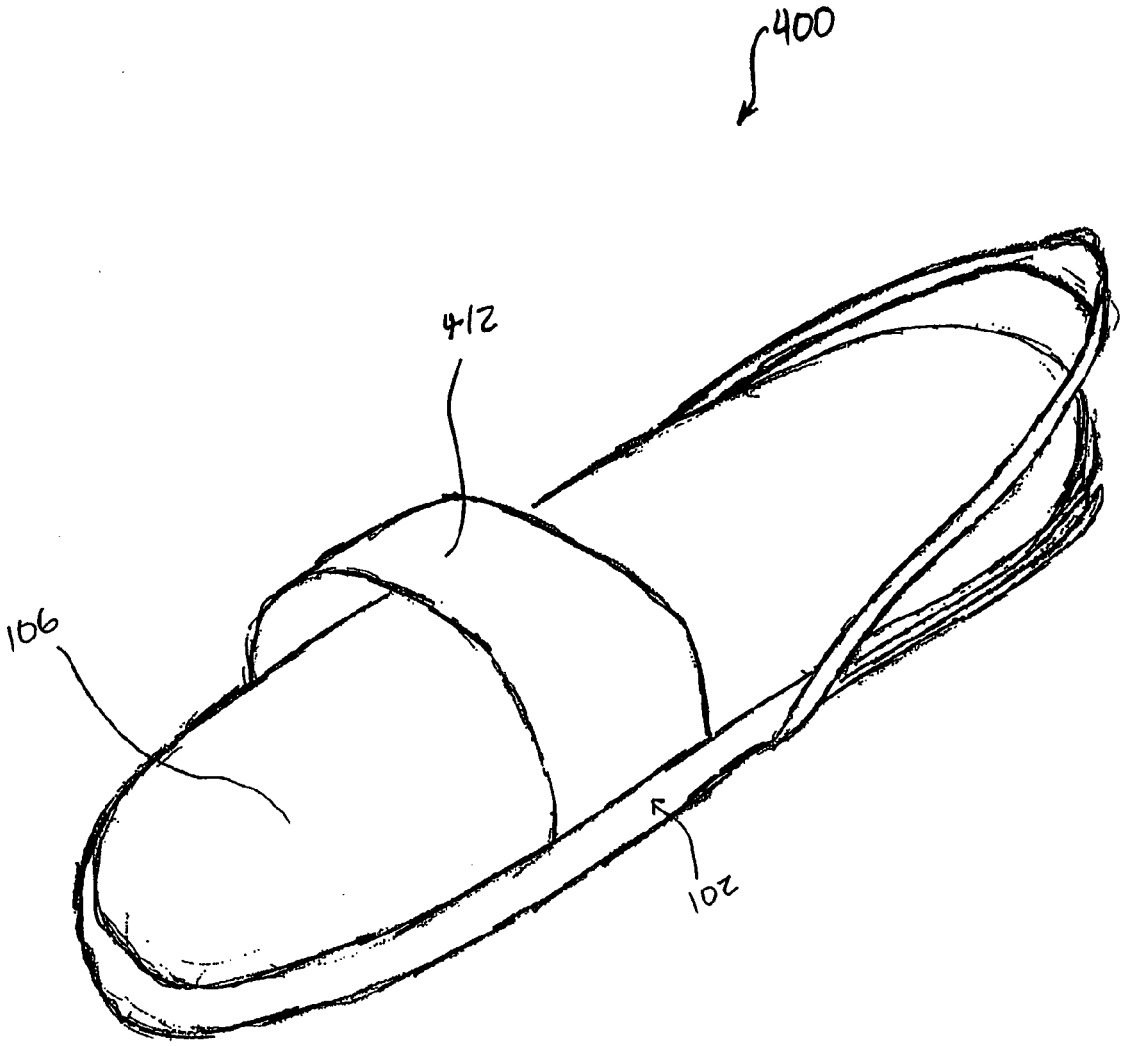
FIG. 4 is an elevated view of an alternative convertible sandal.
Figure 7:
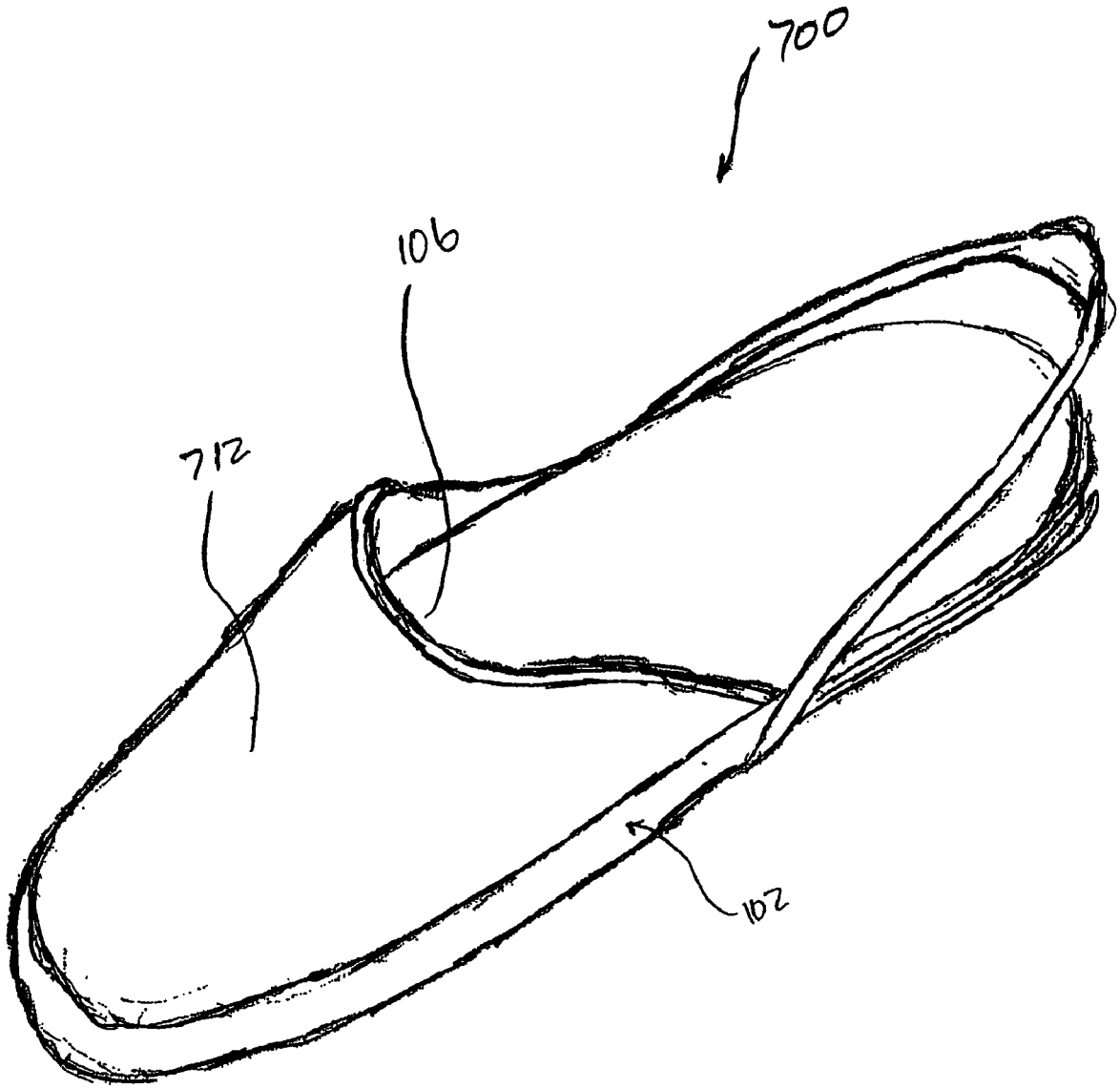
FIG. 7 is an elevated view of an alternative convertible sandal.

The convertible sandal 100 includes a forefoot cover 112, or foot strap, which is securely attached to the sole 102. The forefoot cover 112 is typically embedded in the midsole 105 using conventional means well known within the art. The forefoot cover 112 takes the form of a thong. When a user inserts his foot, the forefoot cover 112 covers his instep and the thong portion 114 lies between the user's first and second toes. The forefoot cover 112 may also be cut or designed to meet any ornamental or functional purpose. FIGS. 4 and 7 show alternative forms which the forefoot cover may take.

The convertible sandal 100 further includes a heel strap 116, or rear heel support member. The heel strap 116 is linked to and extends from the sole 102, and is preferably securely attached to the outsole (not shown) as further described with respect to FIG. 13. The heel strap 116 may alternatively be rotatably attached to the forefoot cover 112 or may be rotatably attached to the sole 102 using rivets, screws, latch members, or any other means known within the art. The heel strap 116 typically sits around the heel of the user and thereby ensures that the sandal remains attached to the user's foot when the user performs such functions as running, walking through water, or walking on the beach. The heel strap 116 is preferably made of an elastic material such as rubber and includes a tab 118 to aid the user in gripping the heel strap 116.

Figure 2:
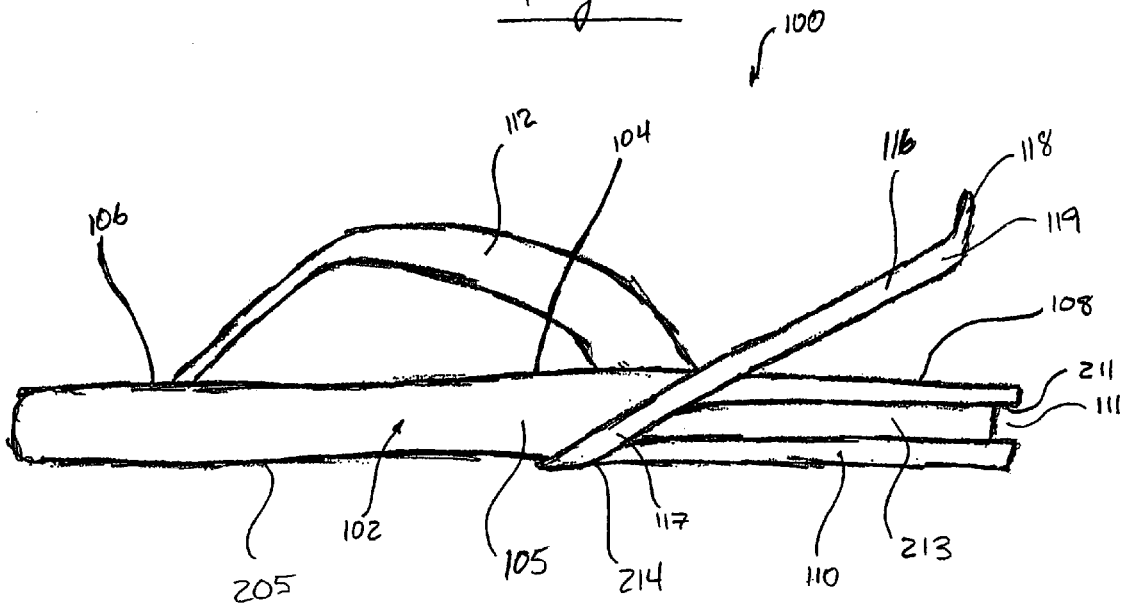
FIG. 2 is a side view of the convertible sandal of FIG. 1 having the heel strap in a raised position.

FIG. 2 is a side view of the convertible sandal 100 of FIG. 1 having the heel strap 116 in a raised position. FIG. 2 shows the convertible sandal 100, including the sole 102, which is comprised of the top surface 104, midsole 105, and outsole 205. The sole 102 is divided into approximately two halves comprising the forefoot portion 106 and the heel portion 108. Attached to the sole 102, and extending over the forefoot portion 106, is the forefoot cover 112, which takes the form of a thong. Also attached to the sole 102 is the heel strap 116. The heel strap 116 is preferably attached to the sole at an attachment point 214 between the forefoot portion 106 and heel portion 108. In such a configuration, a user can secure the heel strap 116 around his heel and ensure that the convertible sandal 100 will not fall off of his foot.

The sidewall 110 forms a perimeter around the midsole 105. Along the heel portion 108, the sidewall 110 is formed to create a groove 111. The groove 111 is defined by the space created under the lip 211 formed by the side channel 213, which preferably wraps around the heel portion 108 of the sidewall 110. The groove 111 is large enough to set the heel strap 116 within the side channel 213 to thereby serve as an interlocking section and thus hold the heel strap 116 to the heel portion 108 of the midsole 105, as seen in FIG. 3.

FIG. 3 is a side view of the convertible sandal 100 of FIG. 1 having the heel strap 116 set within the groove 111 along the heel portion 108 of the midsole 105. As illustrated, a user can set the heel strap 116 within the groove 111, and side channel 213, to thereby interlock the heel strap 116 with the midsole 105. In this configuration, the convertible sandal 100 takes the form of a typical "flip-flop" thong sandal, which may be preferred by the user for added comfort. Since the heel strap 116 is formed of an elastic material, the heel strap holds tightly and securely around the heel portion 108 of the midsole 105.

FIG. 4 is an elevated view of a convertible sandal 400 having a forefoot cover 412 taking the form of a slide. The convertible sandal 400 has the same features and serves the same functions as the convertible sandal 100 of FIG. 1, with the exception that the forefoot cover 412 takes the form of a slide. Such a construction may be preferred by a user for comfort and/or aesthetic reasons. The forefoot cover 412 is attached to the sole 102 and extends over the forefoot portion 106. The forefoot cover 412 can be ornamented and designed in any shape or pattern desirable to the user.

FIG. 5 is a side view of the convertible sandal 400 of FIG. 4 having the heel strap 116 in a raised position.

FIG. 6 is a side view of the convertible sandal 400 of FIG. 4 having the heel strap 116 set within the groove 111 along the heel portion 108 of the midsole 105. The heel strap 116 is interlocked within the groove 111 along the side channel 213 to thereby secure the heel strap 116 to the heel portion 108 of the midsole 105. In this configuration, the user can use the convertible sandal 400 as a typical "flip-flop" slide sandal.

FIG. 7 is an elevated view of a convertible sandal 700 having a forefoot cover 712 taking the form of a clog. The convertible sandal 700 has the same features and serves the same functions as the convertible sandal 100 of FIG. 1, with the exception that the forefoot cover 712 takes the form of a clog, or half shoe vamp. Such a construction may be preferred by a user for comfort and/or aesthetic reasons. The forefoot cover 712 is attached to the sole 102 and extends over the forefoot portion 106. The forefoot cover 712 can be ornamented and designed in any shape or pattern desirable to the user.

FIG. 8 is a side view of the convertible sandal 700 of FIG. 7 having the heel strap 116 in a raised position.

FIG. 9 is a side view of the convertible sandal 700 of FIG. 7 having the heel strap 116 set within the groove 111 along the heel portion 108 of the midsole 105. The heel strap 116 is interlocked within the groove 111 along the side channel 213 to thereby secure the heel strap 116 to the heel portion 108 of the midsole 105. In this configuration, the user can use the convertible sandal 700 as a typical "flip-flop" clog sandal.

Figure 10:
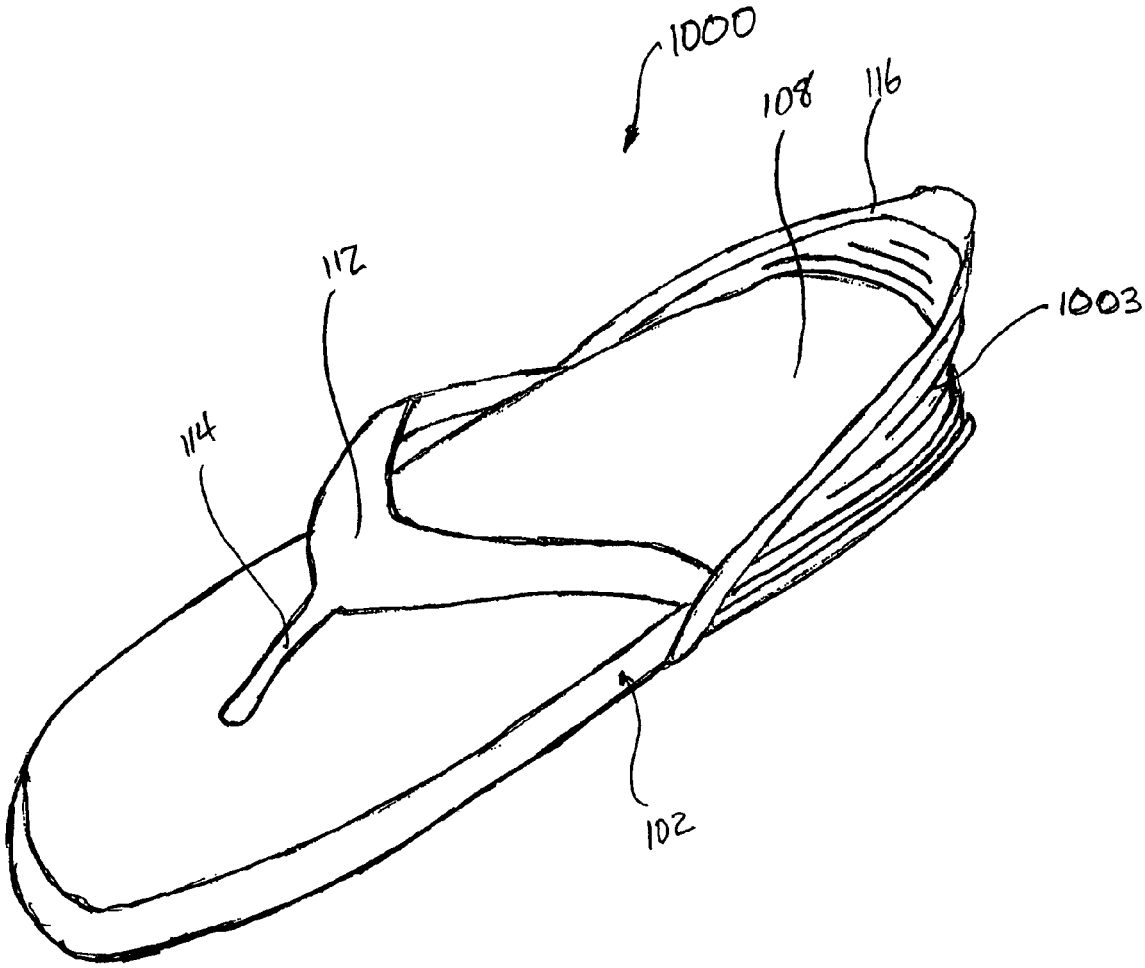
FIG. 10 is an elevated view of yet another alternative convertible sandal.

FIG. 10 is an elevated view of a convertible sandal 1000 having a heel cover 1003 extending between the heel strap 116 and the heel portion 108 of the sole 102. The heel cover 1003 is integral with the heel strap 116 and the heel portion 108 of the sole 102. The heel cover 1003 is preferably formed of a synthetic fabric, but may alternatively be formed of any material such as leather, nylon, or any other material known within the art. The heel cover 1003 may be preferred by the user for added comfort. As illustrated, the forefoot cover 112 takes the form of a thong, having a thong portion 114, as described in FIG. 1.

Figure 11:
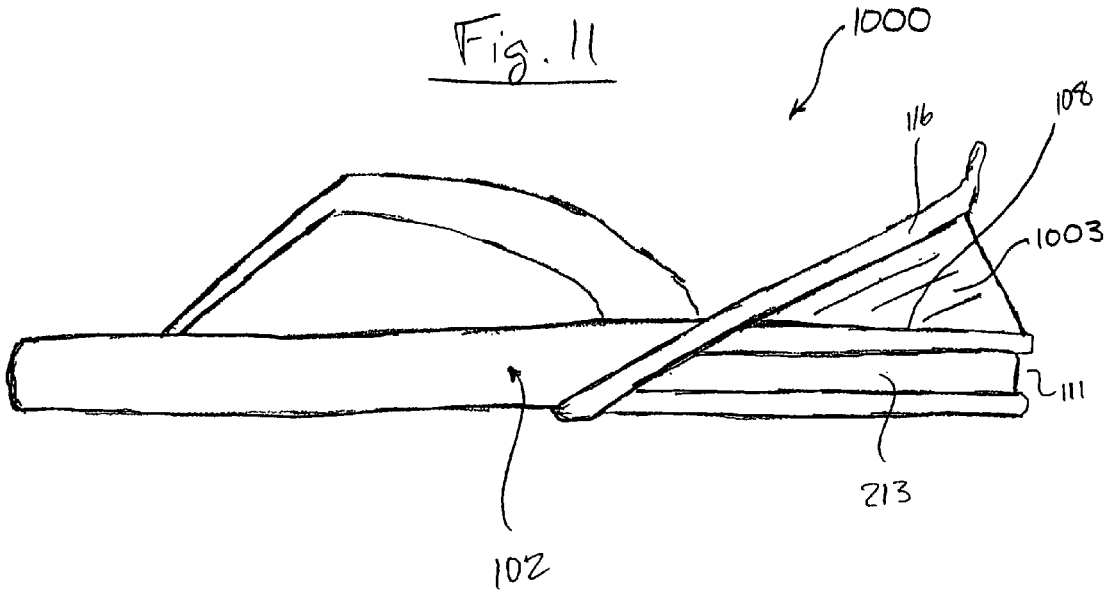
FIG. 11 is a side view of the convertible sandal of FIG. 10 having the heel strap in a raised position.

FIG. 11 is a side view of the convertible sandal 1000 of FIG. 10 having the heel strap 116 in a raised position. As illustrated, the heel cover 1003 extends from the heel portion 108 of the sole 102 to the heel strap 116. In this fashion, a user's heel is covered by the heel cover 1003. Such a construction may be desired for comfort and/or aesthetic reasons.

Figure 12:
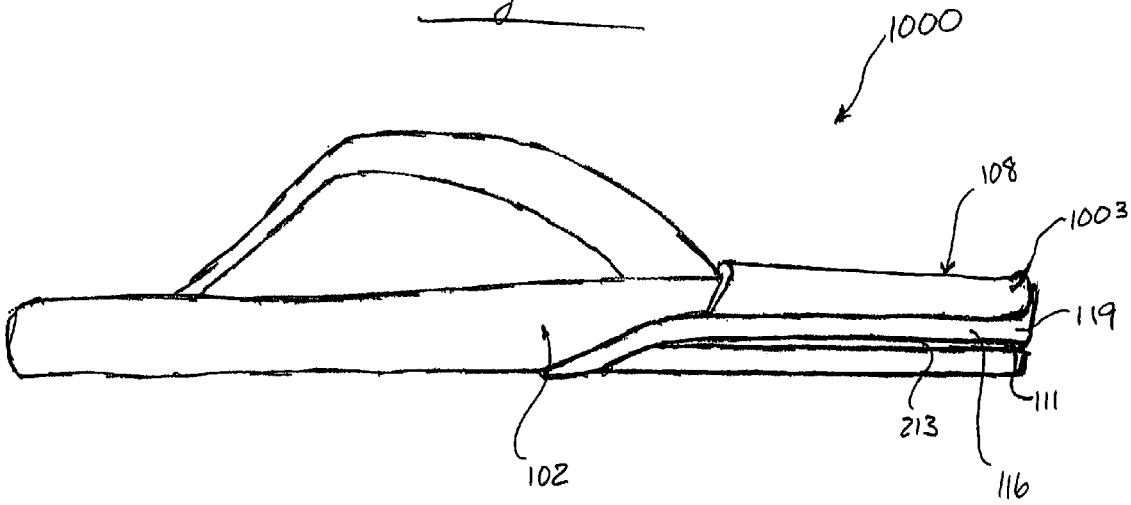
FIG. 12 is a side view of the convertible sandal of FIG. 10 having the heel strap set in a lowered position.

FIG. 12 is a side view of the convertible sandal 1000 of FIG. 10 having the heel strap 116 set within the groove 111 along the heel portion 108 of the midsole 105. In this configuration, heel cover 1003 has been tucked between the heel strap 116 and the heel portion 108 of the midsole 105. As such, the convertible sandal 1000 may be used as a conventional "flip-flop" thong sandal.

Figure 13:
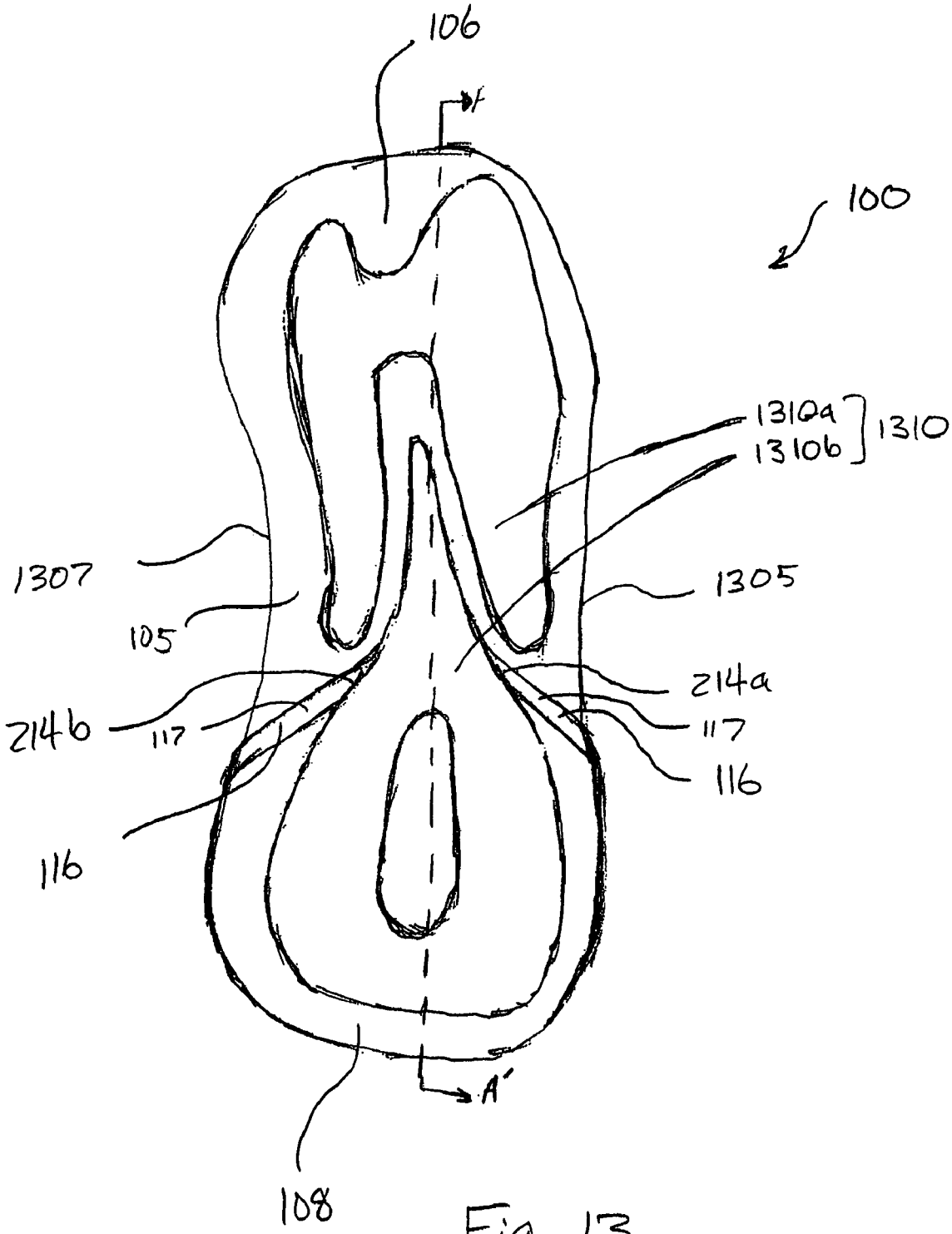
FIG. 13 is a bottom view of the convertible sandal of FIG. 1.

FIG. 13 is a bottom view of the convertible sandal 100 of FIG. 1. The convertible sandal 100 has a lateral side 1305 and a medial side 1307. The convertible sandal 100 also includes an outsole 1310, comprised of forefoot outsole 1310*a*, on the forefoot portion 106 of the midsole 105, and heel outsole 1310*b*, on the heel portion 108 of the midsole 105. The outsole 1310 is typically formed of a rugged rubber material for improved traction and wear. The outsole 1310 is typically glued to the midsole 105. The heel strap 116 is preferably linked to the convertible sandal 100 by gluing the heel strap 116 to the midsole 105 between the midsole and the outsole 1310*b* at attachment points 214*a* and 214*b*. The heel strap 116 may alternatively be linked to the convertible sandal 100 by first creating an opening which transects from the lateral side 1305 to the medial side 1307 of the midsole 105; the heel strap 116 can then be formed to be one continuous piece, wherein at least a portion of the heel strap is disposed within the opening. In such a construction, the heel strap 116 can rotate freely within the opening created through the midsole 105.

Figure 14:
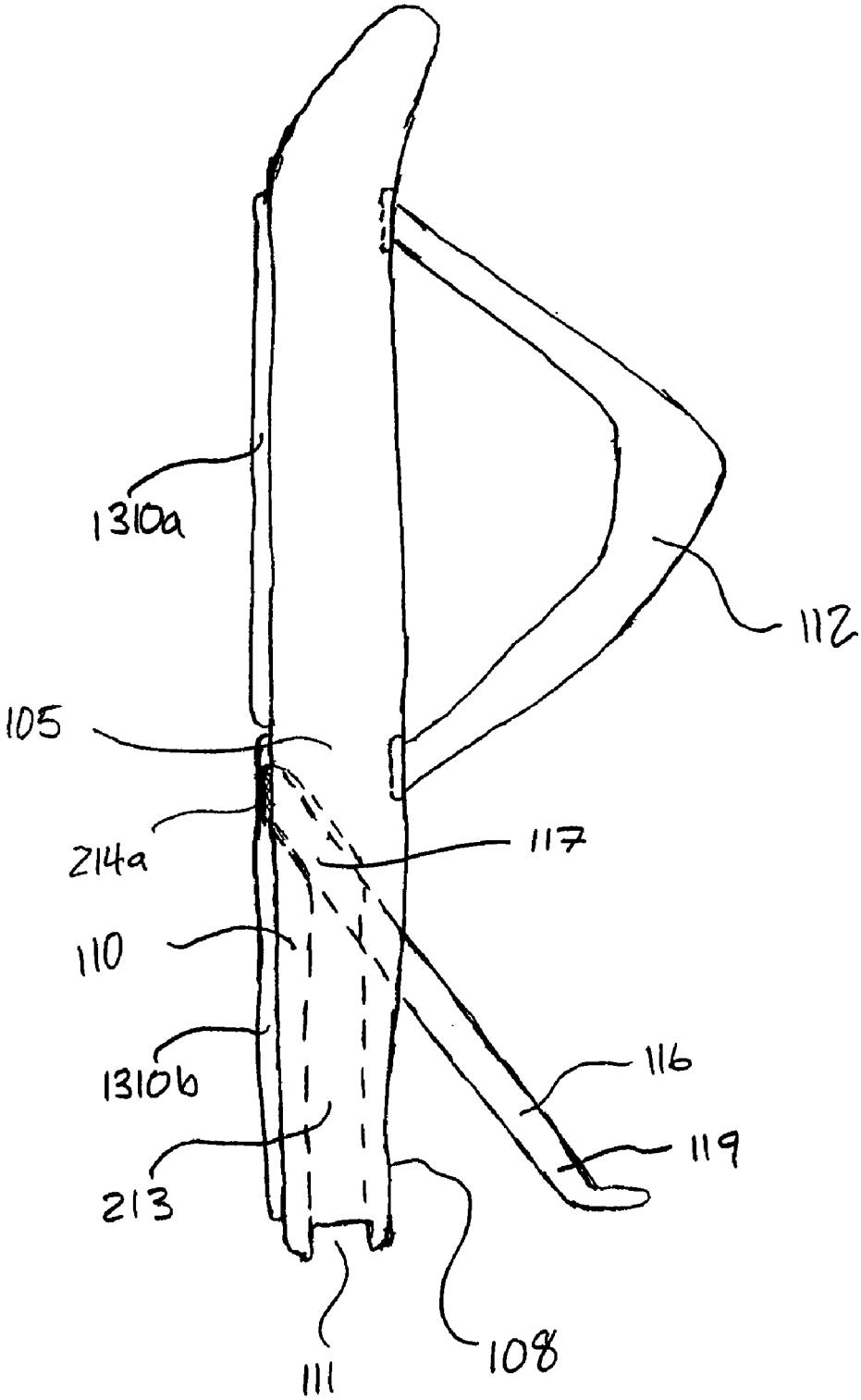
FIG. 14 is a cross-sectional view of the convertible sandal of FIG. 13 cut along line A-A'.

FIG. 14 is a cross-sectional view of the convertible sandal 100 of FIG. 13 cut along line A-A'. As illustrated in FIG. 14, one of the terminal ends of the heel strap 116 is glued to the midsole 105 at attachment point 214*a*. The heel strap 116 then extends upward to a raised position over the heel portion 108 of the midsole 105. Also illustrated in FIG. 14 is the path of the side channel 213 along side wall 110 of the heel portion 108 of the midsole 105. The side channel 213 begins at the attachment point 214*a* and follows along the perimeter of the heel portion 108, concluding at the second attachment point 214*b* (shown in FIG. 13). The side channel 213 is approximately the width and depth of the heel strap 116 such that when the heel strap is positioned appropriately, it can fit, and thereby interlock, within the groove 111 along the side channel 213.

While various embodiments of a convertible sandal have been described, it should be understood that they have been presented by way of example, and not limitation. For example, the forefoot covers illustrated were not intended to be limiting. The forefoot covers may take on any form or configuration desirable to a user. It will be apparent to a person skilled in the relevant art that various changes in form and detail can be made therein without departing from the spirit and scope of the appended claims. For example, instead of having the heel strap 116 fit into the groove 111, the heel strap may be outfitted with a securing device such as a snap which allows the heel strap to stay securely attached to the midsole 105. This may be necessary if the heel strap 116 is not made of an elastic material. In addition, the length of the heel strap 116 may be made of separate pieces, one attached to each side of the midsole. The heel strap 116 can be made adjustable with conventional methods such as the use of VELCRO® fasteners, snaps, buttons, latches, or magnets. Thus the present invention should not be limited by any of the above-described exemplary embodiments, but should be defined only in accordance with the following claims and their equivalents.

What is claimed is:

1. A convertible sandal comprising:

a sole having a top surface, a toe portion, a heel portion, and a side wall, the side wall having an interlocking section along the heel portion of the sole;

a foot strap attached to the sole and extending from the sole over the toe portion of the sole; and, a rear heel support member linked to the sole at first and second attachment points and adapted to be set within the interlocking section of the side wall of the sole between the first and second attachment points to thereby hold the rear heel support member to the side wall of the sole.

2. A convertible sandal as defined in claim 1, wherein the sole is comprised of ethylene vinyl acetate.

3. A convertible sandal as defined in claim 2, wherein the foot strap is comprised of rubber.

4. A convertible sandal as defined in claim 3, wherein the sole is further compnsed of an outsole formed of rubber.

5. A sandal comprising:

a sole having a forefoot portion and a heel portion;

a groove imbedded in the heel portion of the sole;

a forefoot cover attached to the sole and extending over the forefoot portion of the sole; and, a heel strap linked to the sole at first and second attachment points and adapted to be movable between a first position in which said heel strap is set within said groove from the first attachment noint to the second attachment noint and a second position in which said heel strap extends over said heel portion of the sole.

6. A sandal as defined in claim 5, wherein the heel strap includes two terminal ends, each terminal end including a latch member extending therefrom, and wherein the heel strap is linked to the sole by engaging at least one of the latch members with the sole.

7. A sandal as defined in claim 5, wherein the heel strap includes two terminal ends, the sole includes at least one latch member extending therefrom, and wherein the heel strap is linked to the sole by engaging at least one terminal end with at least one latch member.

8. A sandal as defined in claim 5, wherein the heel strap is comprised of an elastic material.

9. A sandal as defined in claim 5, wherein the sole includes a midsole, and the groove on the heel portion of the sole is embedded into the midsole.

10. A sandal as defined in claim 5, wherein the heel strap is attached to the sole with an adhesive.

11. A sandal as defined in claim 5, wherein the heel strap includes two terminal ends and at least one of the terminal ends is linked to the sole with a rivet.

12. A sandal as defined in claim 5, further comprising a heel cover extending from the heel strap and forming a continuous link between the heel strap and the heel portion of the sole.

13. A sandal comprising:

a sole having a toe portion, a heel portion, and a midsole having a side wall;

a side channel along at least a portion of the side wall;

a foot strap attached to the sole and extending over the toe portion of the sole; and, a heel strap linked to the sole at first and second attachment points and adapted to be set within the side channel between the first and second attachment points to thereby interlock with the side wall.

14. A sandal as defined in claim 13, wherein the midsole includes a lateral side, a medial side, and an opening which transects through the midsole from the lateral side to the medial side, and wherein at least a portion of the heel strap is disposed within the opening to thereby link the heel strap with the midsole.

15. A sandal as defined in claim 13, wherein the heel strap is securely attached to the foot strap.

16. A sandal as defined in claim 13, wherein the heel strap is securely attached to the midsole.

17. A convertible sandal comprising:

a sole having a forefoot portion, a heel portion, and a side wall forming a perimeter around the sole;

a forefoot cover attached to the sole and extending over the forefoot portion of the sole;

a heel strap having a proximal portion and a distal portion, the proximal portion of the heel strap being linked to the sole at first and second attachment points, and the distal portion of the heel strap extending over the heel portion of the sole; and means for removably securing the distal portion of the heel strap to the side wall of the heel portion of the sole, wherein said heel strap is adapted to be movable between a first position in which the distal end of the heel strap extends over said heel portion of the sole to secure a portion of a foot thereto and a second position in which the heel strap is secured to the heel portion of the sole from the first attachment point to the second attachment point.

18. A convertible sandal defined in claim 17, wherein the means for removably securing the distal portion of the heel strap to the heel portion of the sole includes a hook and loop fastener.

19. A convertible sandal defined in claim 17, wherein the means for removably securing the distal portion of the heel strap to the heel portion of the sole includes an interlocking section formed of a groove embedded into the heel portion of the sole.

20. A convertible sandal defined in claim 17, wherein the means for removably securing the distal portion of the heel strap to the heel portion of the sole includes a snap.

21. The convertible sandal of claim 1, wherein said sole further comprises a bottom portion, and wherein said interlocking section extends to said bottom portion.

22. A sandal, comprising:

a sole having a top surface, a toe portion, a heel portion, and a side wall, the side wall having an interlocking section along the heel portion of the sole; and a support member linked to the sole at first and second attachment points, wherein said support member is adapted to be movable between a first position in which said support member is set within said interlocking section from the first attachment point to the second attachment point and a second position in which said support member extends over a portion of said top surface of the sole.

23. A sandal as defined in claim 22, wherein the sole is comprised of ethylene vinyl acetate.

24. A sandal as defined in claim 22, wherein the sole includes a lateral side, a medial side, and an opening which transects through the sole from the lateral side to the medial side, and wherein at least a portion of the support member is disposed within the opening to thereby link the support member with the sole.

* * * * *